US005677661A

United States Patent [19]

Jang

[11] Patent Number: 5,677,661

[45] Date of Patent: Oct. 14, 1997

[54] ROTARY TRANSFORMER

[75] Inventor: Woo Sung Jang, Seoul, Rep. of Korea

[73] Assignee: LG Electronics Inc., Seoul, Rep. of Korea

[21] Appl. No.: 567,716

[22] Filed: Dec. 5, 1995

[30] Foreign Application Priority Data

Dec. 7, 1994 [KR] Rep. of Korea ..... 33131

[51] Int. Cl.[6] ..... H01F 19/00; H01F 27/24

[52] U.S. Cl. ..... 336/120; 336/212; 336/219

[58] Field of Search ..... 336/119, 120, 336/117, 212, 219, 233, 234

[56] References Cited

U.S. PATENT DOCUMENTS 3,328,735 6/1967 Honsinger ..... 336/120

3,531,749 9/1970 Treter et al. ..... 336/120

*Primary Examiner*—Thomas J. Kozma

*Attorney, Agent, or Firm*—John P. White

[57] ABSTRACT

A method for the manufacture of a rotary transformer in accordance with the present invention comprises the steps of forming two cylindrical stator ferrite blocks with the same inner diameter but different outer diameters and two cylindrical rotor ferrite blocks with different inner diameters but the same outer diameter; smoothly grinding the inner and outer surfaces of the above cylindrical rotor and stator ferrite blocks and cutting them into a plurality of rotor and stator rings, respectively; applying a bonding agent to the top and the bottom surfaces of the rotor and stator rings and layering them in order to thereby form a plurality of rotor channel grooves and stator channel grooves; inserting a catalyst between the layers that form the stator and rotor channel grooves; heating and pressing together the layered rotor and stator rings in a furnace; and, after heating and pressing, threading the coils into the channel grooves and combining the rotor and stator transformers to thereby complete the rotary transformer, thus dispensing with the need to form separate short ring grooves, and reducing the proportion of defective products.

1 Claim, 7 Drawing Sheets

ROTARY TRANSFORMER

FIELD OF THE INVENTION

The present invention relates to a rotary transformer and a method for the manufacture thereof, and, more particularly, to a rotary transformer, incorporating therein a rotor ferrite block formed by joining a number of patterned cylindrical ferrite blocks by applying a glass powder between them, that permits a stator ferrite block to be installed in its central shaft hole, thus increasing an efficiency of, and reducing a number of defective products produced during, a manufacturing process, and to a method for the manufacture thereof.

DESCRIPTION OF THE PRIOR ART

Ordinarily, a rotary transformer incorporated in a rotary drum of, e.g., a video tape recorder, a camcorder, or a digital audio tape recorder, receives a reproduced signal from a magnetic head installed on the rotary drum, and passes it on to a stator driving circuit, or, in the alternative, receives a recording signal from the stator driving circuit and transmits it to the magnetic head. Thus, the rotary transformer plays a very important role in magnetic signal reproduction and recording devices.

FIGS. 1A to 1C are cross sectional views illustrating a conventional rotary drum manufacturing process; and FIG. 2 is a cross sectional view illustrating a defective conventional rotary transformer.

First, referring to FIGS. 1A and 1B, a stator ferrite block (11) and a rotor ferrite block (12) each having a circumferential surface and an inner surface with different diameters, are formed via a powder-forming method. Subsequently, the circumferential and inner surfaces of the rotor and stator ferrite blocks (11), (12), are ground smooth by using a grinder.

Next, as illustrated in FIG. 1A, a plurality of circular stator channel grooves (13), as many as the desired number of channels, are formed around the circumferential surface of the stator ferrite block (11). In addition, a short ring groove (14) is formed between each of the stator channel grooves (13).

Using the same method, as illustrated in FIG. 1B, a plurality of circular rotor channel grooves (15) are formed around the inner surface of the rotor ferrite block (12). It should be noted that there are as many rotor channel grooves (15) as there are stator channel grooves (13).

Then, a coil threader (not shown) is used to thread a stator coil (16) into each of the circular stator channel grooves (13). Following this, a short ring coil (18) is threaded into each short ring groove (14). Finally, a rotor coil (17) is threaded into each circular rotor channel groove (15).

Subsequently, as shown in FIG. 1C, the manufacturing process of rotary transformer is completed by putting together the stator ferrite block (11) and the rotor ferrite block (12) such that the circular stator channel grooves (13) and the circular rotor channel grooves (15) are directly opposite each other.

The reason for threading the short ring coils (18) into the short ring grooves (14) prepared around the circumferential surface of the stator ferrite block (11) is to reduce an interference that might arise between each channel during the operation of the rotary drum.

Meanwhile, the steps in the manufacturing process for the above described rotary transformer are carried out in the order presented in FIG. 3. In the first step, the stator ferrite block (11) and the rotor ferrite block (12) are formed into cylinders.

In the second step, the circumferential surface and the inner surface of the stator and rotor ferrite blocks (11), (12) are ground smooth with, i.e., a grinder.

Next, the stator channel grooves (13) and the short ring grooves (14) are formed around the circumferential surface of the stator ferrite block (11), while the rotor channel grooves (15) are formed into the inner surface of the rotor ferrite block (12).

In the following step, the stator coils (16), the rotor coils (17), and the short ring coils (18) are threaded into the stator channel grooves (13), the rotor channel grooves (15), and the short ring grooves (18), respectively.

The conventional rotary transformer manufactured by the above described process comprises a stationary stator transformer and a rotating rotary transformer. The cylindrical rotor ferrite block (12) which constitutes the rotary transformer is fitted around the cylindrical stator ferrite block (11) which constitutes the stator transformer while maintaining a minute predetermined separation.

The stator channel grooves (13) and the rotor channel grooves (15) are formed into the circumferential surface of the stator ferrite block (11) and the inner surface of the rotor ferrite block (12), respectively, while maintaining a facing relationship with each other.

The stator coils (16) and the rotor coils (17) are threaded into the stator channel grooves (13) and the rotor channel grooves (15), respectively, and transmit signals back and forth by an induced electromotive force.

In addition, the short ring coils (18) are threaded into the short ring grooves (14) which are formed around the circumferential surface of the stator ferrite block (11), interposed between each of the stator channel grooves (13). As stated above, the role of the short ring coils (18) is to reduce interference between each of the channels.

Thus, when an apparatus whereon the stator and rotor transformers are installed while maintaining a separation of a few tenths of microns (μm) is put into a reproduction mode, the signals recorded on a magnetic tape are read by the heads, and transmitted by the rotor coils (17) to the stator coils (16).

The signal is then transmitted to the driving circuit block for reproduction. Similarly, when the apparatus is put into a recording mode, the driving circuit block sends the received signals to the stator coils (16) to be transmitted to the rotor coils (17), thus allowing the signals to be passed on to the heads to be recorded on the magnetic tape.

However, the conventional manufacturing method for the rotary transformer described above suffers from the disadvantage that as the channel grooves and short ring grooves incorporated into the cylindrical ferrite blocks have to be machined individually, production efficiency is very low, and mass production impractical.

In addition, as illustrated in FIG. 2, during the insertion of the stator ferrite block (11) into the shaft hole of the rotor ferrite block (12), or during the formation of the stator channel grooves (13) and short ring grooves (14), the edge portions of the grooves may be damaged, leading to a defective final product.

Furthermore, there is a limit to how small the stator and rotor ferrite blocks (11), (12) can be made if the channel and short ring grooves are to be machined thereon, thus making it very difficult to reduce the size of the rotary transformer.

SUMMARY OF THE INVENTION

The present invention aims to solve the above described problems. It is an object of the present invention to provide a rotary transformer and a manufacturing method thereof wherein a rotor and a stator are formed by layering on top of one another a plurality of rings with different diameters and coils are threaded into the resulting grooves, thus lowering the proportion of defective final products and making it possible to lower production costs.

It is another object of the present invention to provide a rotary transformer formed by depositing and bonding layers and a manufacturing method thereof amenable to reductions in size and increased production efficiency.

The rotary transformer in accordance with the present invention comprises a stator ferrite block formed by layering on top of one another a plurality of stator rings with different outer diameters, threading coils into the stator channel grooves thus formed, and interposing an insulating layer between the above stator channel grooves to give rise to a plurality of channel short ring grooves; and a rotor ferrite block formed by layering on top of one another a plurality of rotor rings with different inner diameters that loosely fit around the stator rings, threading coils into the rotor channel grooves thus formed, and interposing an insulating layer between the above rotor channel grooves to give rise to a plurality of channel short ring grooves.

In addition, the method for the manufacture of the rotary transformer in accordance with the present invention comprises the steps of forming two cylindrical stator ferrite blocks with the same inner diameter but different outer diameters and two cylindrical rotor ferrite blocks with different inner diameters but the same outer diameter; after smoothly grinding the inner and outer surfaces of the above cylindrical rotor and stator ferrite blocks cutting them into a plurality of rotor and stator rings, respectively; applying a bonding agent to the top and the bottom surfaces of the rotor and stator rings and layering them in order to thereby form a plurality of rotor channel grooves and stator channel grooves; inserting a catalyst between the layers that form the stator and rotor channel grooves; heating and pressing together the layered rotor and stator rings in a furnace; and, after heating and pressing, threading the coils into the channel grooves and combining the rotor and stator transformers to thereby complete the rotary transformer.

BRIEF DESCRIPTION OF THE DRAWINGS

The above and other objects and features of the present invention will become apparent from the following desription of the preferred embodiments given in conjunction with the accompanying drawings in which.

DETAILED DESCRIPTION OF THE PREFERRED EMBODIMENTS

A rotary transformer and a method for the manufacture thereof in accordance with an embodiment of the present invention is described below while making references to the attached diagrams.

FIGS. 4A to 4D are cross sectional views illustrating a method for the manufacture of a rotary drum in accordance with the present invention while FIGS. 5A to 5D are cross sectional views showing a process for the manufacture of a stator ferrite block incorporated in the inventive rotary transformer.

Figure 7:
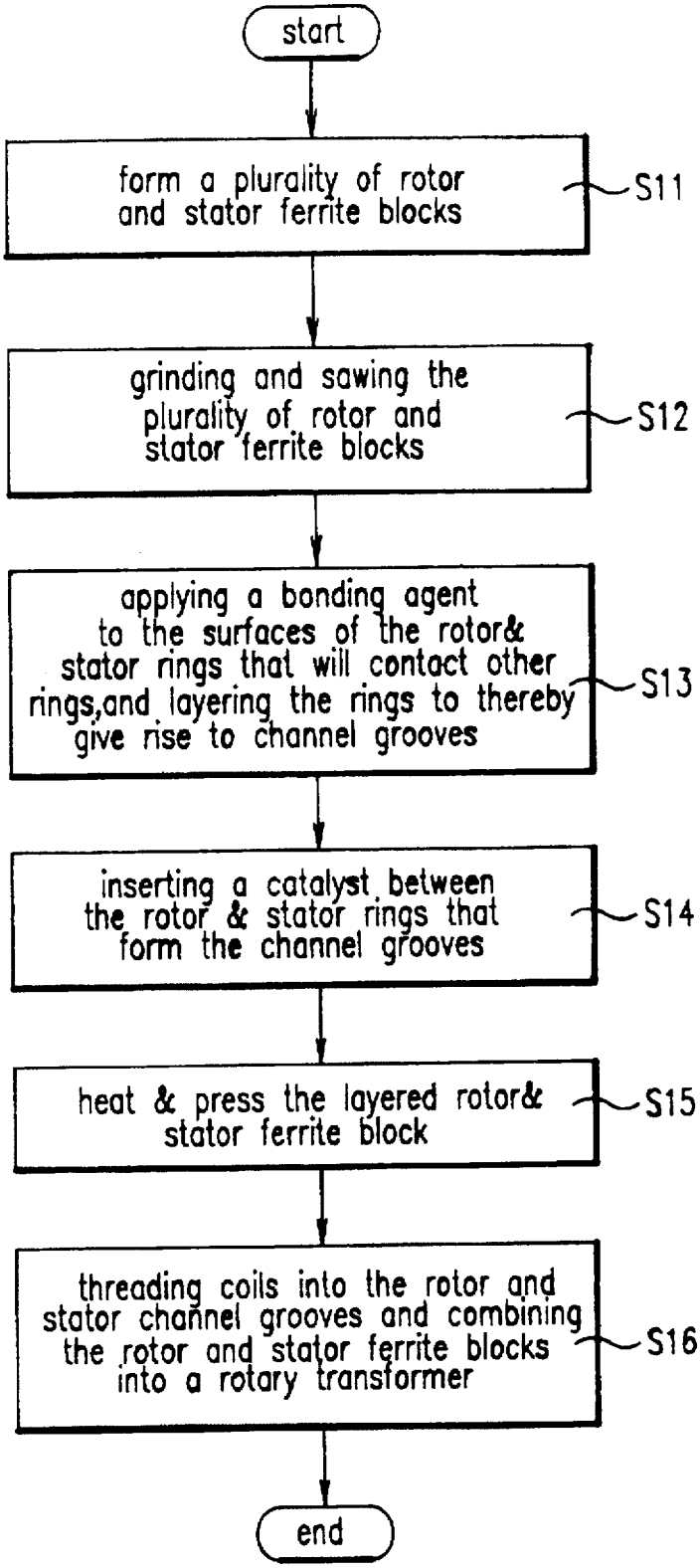
FIG. 7 illustrates the order of the steps in a method for the manufacture of a rotary transformer in accordance with the present invention.

The method for the manufacture of a rotary transformer presented in FIGS. 4A to 4D, and in FIGS. 5A to 5D is described below while making additional references to FIG. 7.

Figure 1A:
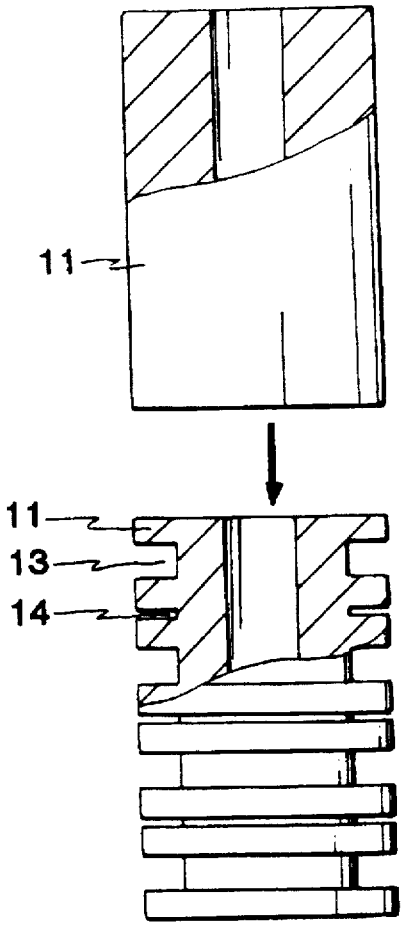
FIG.1A prior art
FIGS. 1A to 1C illustrate a method for the manufacture of a rotary drum of prior art.
Figure 1B:
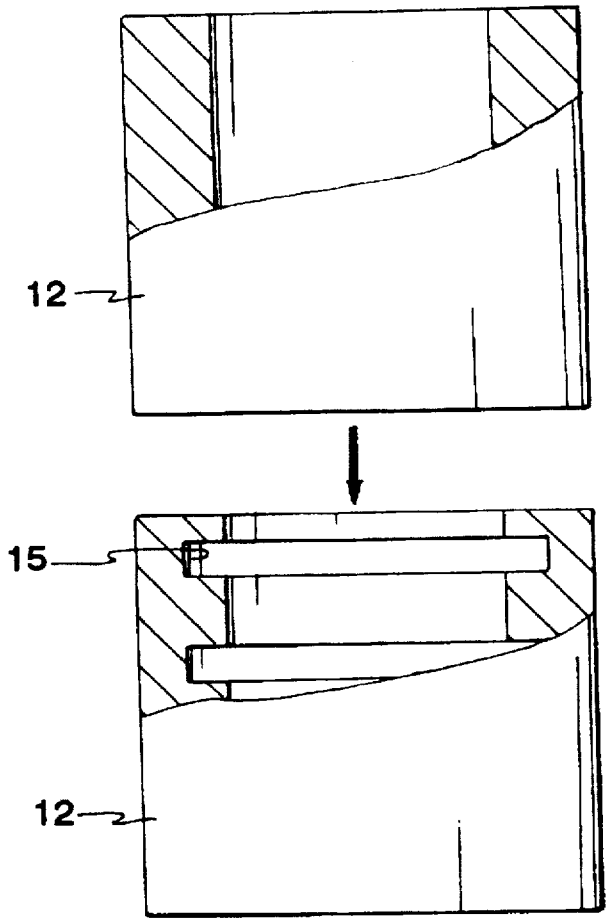
FIG.1B prior art
Figure 1C:
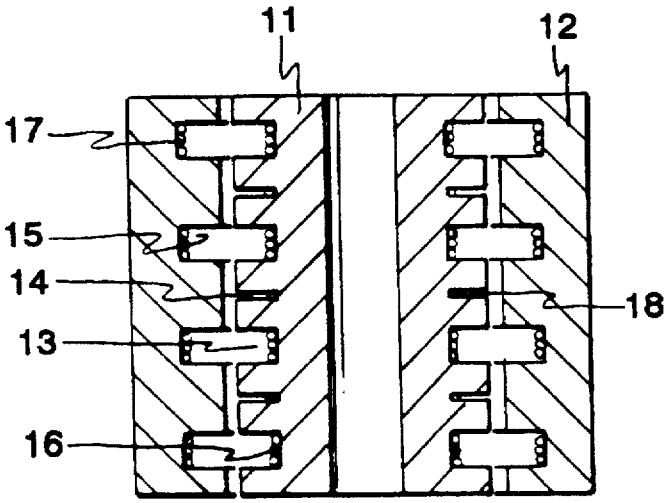
FIG.1C prior art
Figure 2:
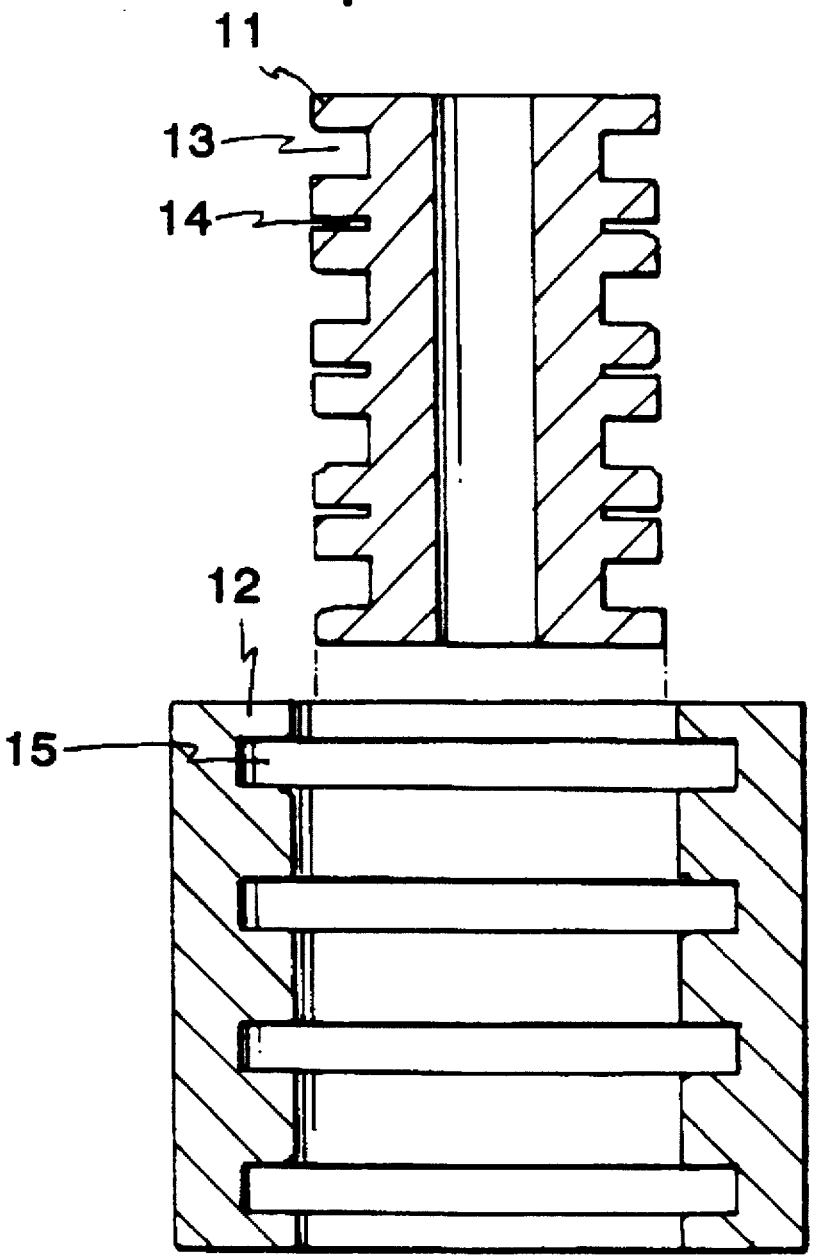
FIG.2 prior art
FIG. 2 shows a conventional rotary drum in a defective state.
Figure 3:
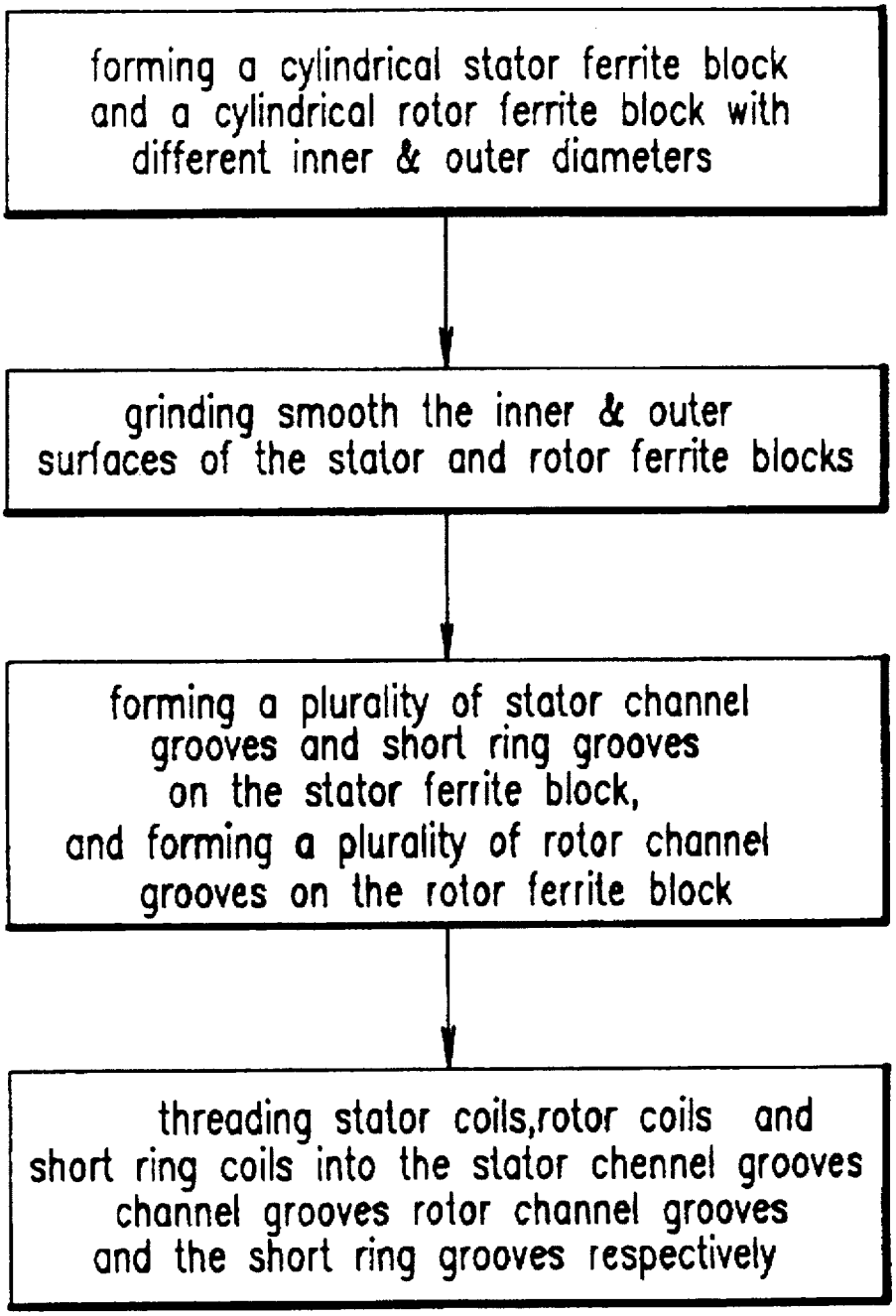
FIG.3 prior art
FIG. 3 presents the order of the steps in a method for the manufacture of a rotary drum of prior art.
Figure 4A:
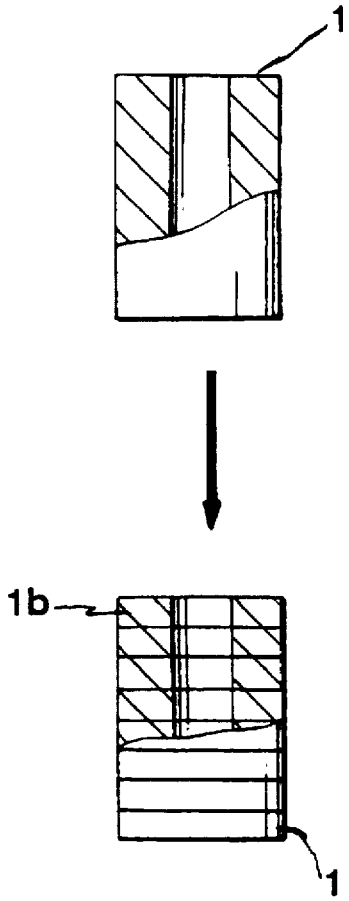
FIGS. 4A to 4D illustrate a method for the manufacture of a rotary drum in accordance with the present invention.
Figure 4B:
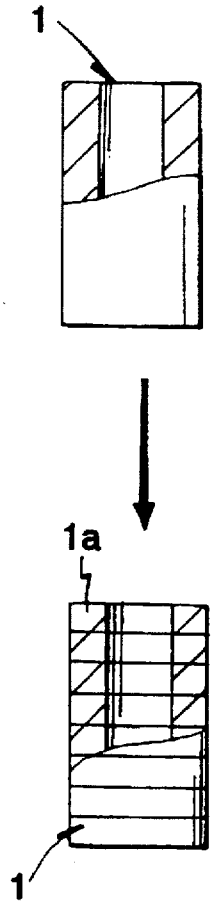
Figure 4C:
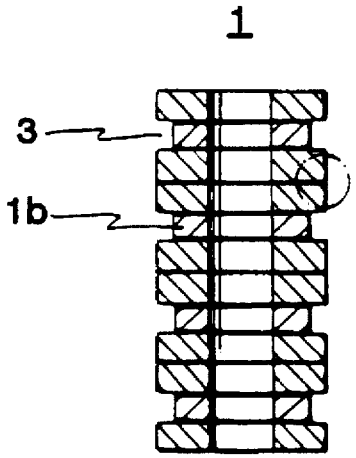
Figure 4D:
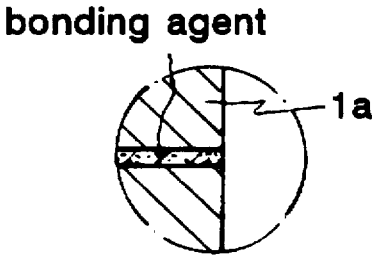

First, as shown in FIGS. 4A, 4B, two cylindrical stator ferrite blocks (1) with the same inner diameter and different outer diameters are formed (S11).

Figure 5A:
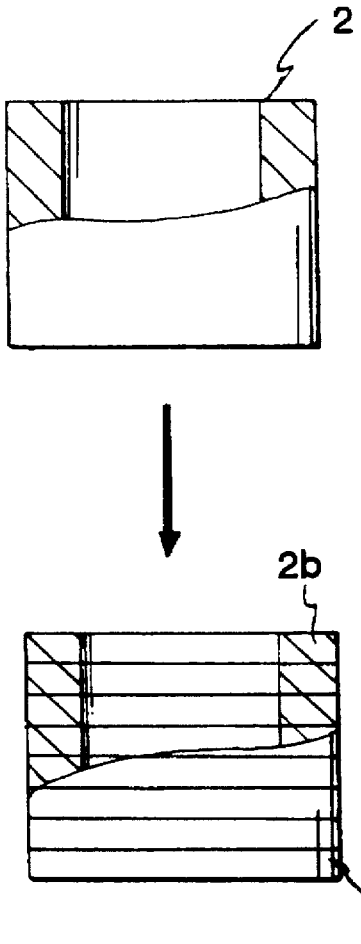
FIGS. 5A to 5D show a process for the manufacture of a stator ferrite block incorporated in the inventive rotary transformer.
Figure 5B:
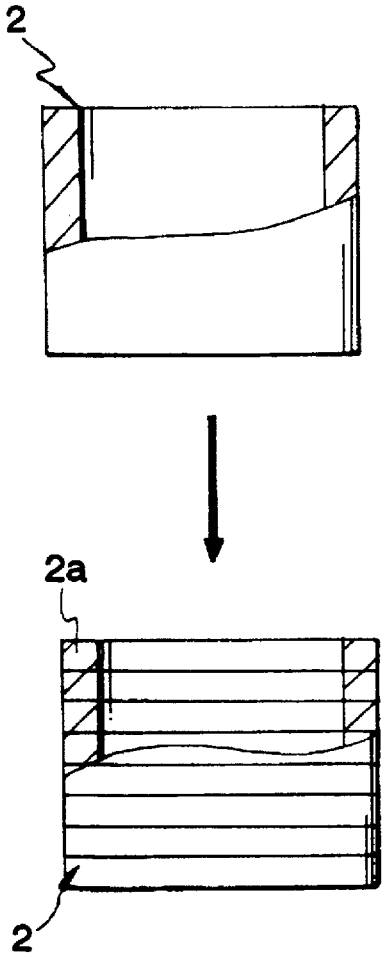
Figure 5C:
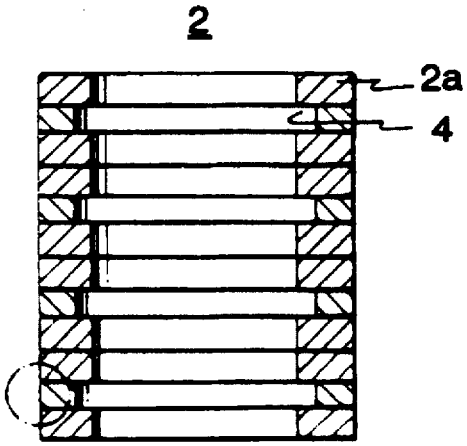
Figure 5D:
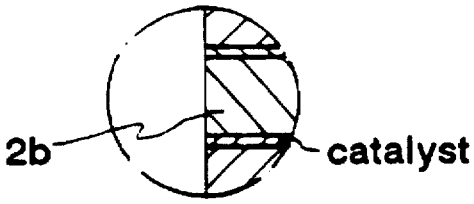

At the same time, as illustrated in FIGS. 5A, 5B, two cylindrical rotor ferrite blocks (2) with the same outer diameter and different inner diameters are formed (S11).

Next, the outer and inner surfaces of the stator ferrite blacks (1) and the rotor ferrite blocks (2) are ground smooth. Following this, the two stator ferrite blocks (1) are cut up into a plurality of stator rings (1*a*), (1*b*), while the rotor ferrite blocks (2) are cut up into a plurality of rotor ferrite rings (2*a*), (2*b*) concurrently (S12).

Subsequently, the stator rings (1*a*), (1*b*), and the rotor rings (2*a*), (2*b*) are stacked on top of each other after applying a glass powder or an electrically nonconducting boding agent, e.g., an epoxy compound, to the appropriate surfaces, i.e., the top and bottom surfaces that contact other rings, by using a melting jig, to thereby give rise to a plurality of channel grooves (S13).

At this time, nitric acid ($HNO_3$) or phosphoric acid ($HPO_3$) is injected as a catalyst between the rings that form the rotor and stator channel grooves (4) and (3). (S14)

Next, the stator and rotor ferrite blocks (1), (2) that have been formed by layering the rings in steps (S11 to S13) are heated and pressed together in a furnace at 1000 to 1300 degrees celsius, and at a pressure of 300 g/cm (S15).

The first stator rings (1*a*) and the second stator rings (1*b*), and the first rotor rings (2*a*) and the second rotor rings (2*b*) that form the channel grooves, and between which the nitric acid has been injected, undergo a solid phase reaction at their boundaries, and are, as a consequence, completely joined together. In the meantime, the glass powder that has been applied between the first stator rings (1*a*) and the first rotor lings (2*a*) melts and binds together the remaining rings. This glass layer plays the same role as the short ring coil in the conventional rotary transformer, reducing the interference between adjacent channels.

Figure 6:
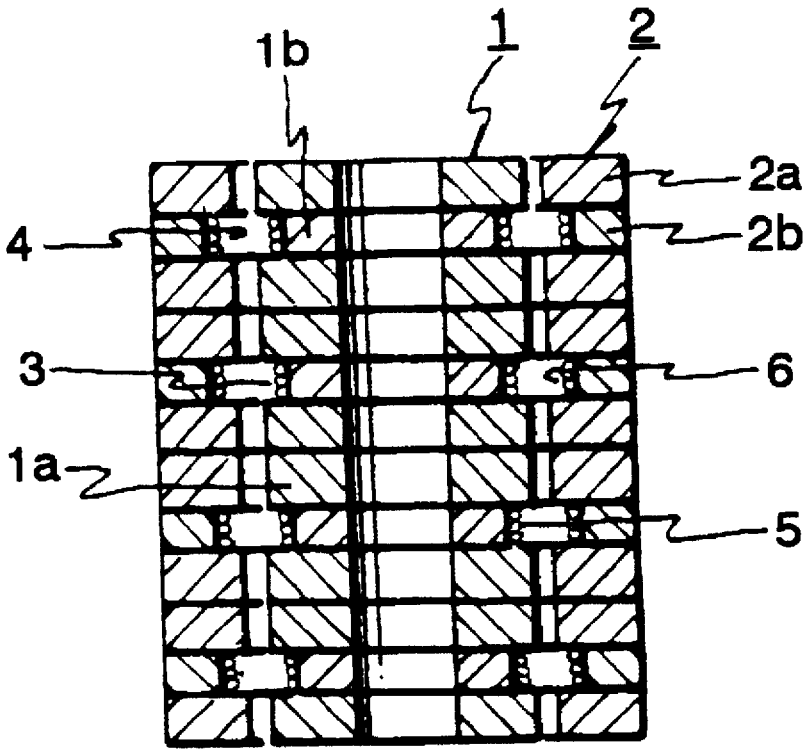
FIG. 6 presents a rotary transformer in accordance with an embodiment of the present invention.

After the stator and rotor channel grooves (3), (4) have been formed by joining the first and second stator ring (1*a*), (1*b*) and the first and second rotor rings (2*a*), (2*b*), stator coils (5) are threaded into the stator channel grooves (3) and rotor coils (6) threaded into the rotor channel grooves (4) as shown in FIG. 6, to thereby complete the assembly process for the rotary transformer.

FIG. 6 illustrates a cross sectional view of a rotary transformer in accordance with an embodiment of the present invention.

Referring to FIG. 6, the stator ferrite block (1) is furnished with a stationary shaft insertion hole (7), a plurality of stator channel grooves (3) formed by layering on top of one another a plurality of stator rings (1*a*), (1*b*) with different outer diameters, a plurality of stator coils threaded into the stator channel grooves (3), and a plurality of channel short rings formed by providing an insulating layer between each of the stator channel grooves (3).

Meanwhile, the rotor ferrite block (2) is installed so that its inner surface is facing the outer surface of the stator ferrite block (1), and is furnished with a plurality of rotor channel grooves (4) formed by layering on top of one another a plurality of rotor rings (2*a*), (2*b*) with different inner diameters, as well as with a plurality of rotor coils threaded into the rotor channel grooves (4).

The rotary transformer in accordance with the present invention described above is manufactured by a method comprising the steps of forming two cylindrical stator ferrite blocks with the same inner diameter but different outer diameters and two cylindrical rotor ferrite blocks with different inner diameters but the same outer diameter; after smoothly grinding the inner and outer surfaces of the above cylindrical rotor and stator ferrite blocks cutting them into a plurality of rotor and stator rings, respectively; applying a bonding agent to the top and the bottom surfaces of the rotor and stator rings and layering them in order to thereby form a plurality of rotor channel grooves and stator channel grooves; inserting a catalyst between the layers that form the stator and rotor channel grooves; heating and pressing together the layered rotor and stator rings in a furnace; and, after heating and pressing, threading the coils into the channel grooves and combining the rotor and stator transformers to thereby complete the rotary transformer, thus making it possible to dispense with separate short ring channels, and reducing the proportion of defective final products.

In addition, the rotary transformer and the method for the manufacture thereof in accordance with the present invention does not require the stator and rotor channel grooves to be formed in a separate step, thus being more amenable to mass production and making it possible to reduce the size of the rotary transformer.

The rotary transformer and the method for the manufacture thereof in accordance with the present invention make it possible to provide a rotary transformer by forming a plurality of stator rings and rotor rings, and then layering them one on top of one another by using a variety of bonding agents. Thus, it should be self-evident that although the present invention has been shown and described with respect to the preferred embodiments only, many changes and modifications may be made without departing from the spirit and scope of the present invention as set forth in the appended claims.

What is claimed is:

1. A rotary transformer for use in a tape recorder, the rotary transformer comprising:

a stator ferrite block provided with a shaft insertion hole, and formed by layering on top of one another a plurality of stator rings with different outer diameters, threading coils into the stator channel grooves thus formed, and forming a plurality of channel short ring grooves by interposing an insulating layer between the above stator channel grooves; and a rotor ferrite block formed by layering on top of one another a plurality of rotor rings with different inner diameters that loosely fit around the stator rings, threading coils into the rotor channel grooves thus formed, and forming a plurality of channel short ring grooves by interposing an insulating layer between the above rotor channel grooves.

* * * * *